US010874578B2

(12) United States Patent
Bennett

(10) Patent No.: US 10,874,578 B2
(45) **Date of Patent: *Dec. 29, 2020**

(54) INFLATION GARMENT HAVING A PORTABLE CONTROLLER FOR TREATMENT OF DVT

(71) Applicant: John A. Bennett, Villanova, PA (US)

(72) Inventor: John A. Bennett, Villanova, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/706,502

(22) Filed: Dec. 6, 2019

(65) Prior Publication Data

US 2020/0261303 A1 Aug. 20, 2020

Related U.S. Application Data

(63) Continuation-in-part of application No. 16/276,176, filed on Feb. 14, 2019, now Pat. No. 10,500,125.

(51) Int. Cl.
*A61H 9/00* (2006.01)

(52) U.S. Cl.
CPC ..... *A61H 9/0092* (2013.01); *A61H 9/0078* (2013.01); *A61H 2201/0157* (2013.01); *A61H 2201/164* (2013.01); *A61H 2201/165* (2013.01); *A61H 2209/00* (2013.01)

(58) Field of Classification Search
CPC . A61H 1/00; A61H 9/00; A61H 9/005; A61H 9/0078; A61H 23/00; A61H 23/04; A61H 2209/00; A61H 2201/165; A61H 2201/0157; A61H 2201/50; A61H 2201/0103; A61H 2201/0192; A61H 2201/162; A61H 2201/164; A61H 2201/5007; A61H 2205/06; A61H 2205/10; A61H 2205/106; A61H 2205/108; Y10T 24/45052; Y10T 24/45215; Y10T 24/45262; Y10T 403/75
See application file for complete search history.

(56) References Cited

U.S. PATENT DOCUMENTS 8,177,734 B2 5/2012 Vess
8,394,042 B1 3/2013 Mirza
8,403,870 B2 3/2013 Vess
(Continued)

FOREIGN PATENT DOCUMENTS

KR 101059856 B1 * 8/2011

*Primary Examiner* — Quang D Thanh
*Assistant Examiner* — Matthew R Moon
(74) *Attorney, Agent, or Firm* — Miller Law Group, PLLC

(57) ABSTRACT

An inflation garment for the treatment of DVT is operated by a portable, battery powered air pump and controller detachably mounted on the inflation garment. The controller is formed with hook-fastening devices on the bottom surface of the controller that is detachably engagable with the material on the outer surface of the inflation garment. To mount the controller, the inflation garment is folded to expose the air inlet and outlet ports on the inflation garment to facilitate the operative attachment of the controller ports, then the inflation garment is unfolded and pressed against the bottom surface of the controller to engage the hook fasteners with the material of the inflation garment. A supplemental support is provided to wrap at least partially around the inflation garment to enhance the support of the inflation garment on the patient's limb without slipping.

11 Claims, 8 Drawing Sheets

(56) References Cited

U.S. PATENT DOCUMENTS

| | | | | |
|---|---|---|---|---|
| 8,535,253 | B2 | 9/2013 | Vess | |
| 8,784,346 | B2 | 7/2014 | Barak | |
| 8,801,643 | B2 | 8/2014 | Deshpande et al. | |
| 9,044,372 | B2 | 6/2015 | Wild et al. | |
| 9,668,932 | B2 * | 6/2017 | Mansur, Jr. ..... | A61H 9/0078 |
| 10,500,125 | B2 * | 12/2019 | Bennett ..... | A61H 9/0078 |
| 2008/0262399 | A1 | 10/2008 | Kovelman | |
| 2014/0303533 | A1 | 10/2014 | Zeutzius | |

* cited by examiner

Fig. 3
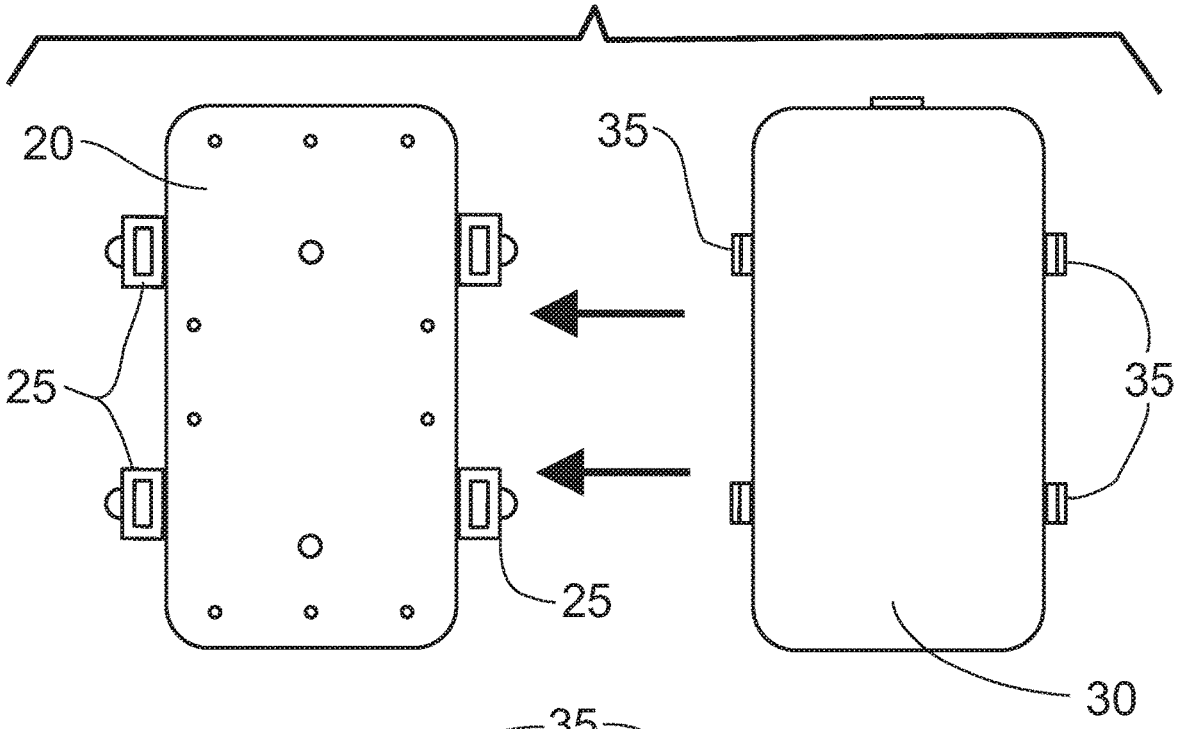
Fig. 4
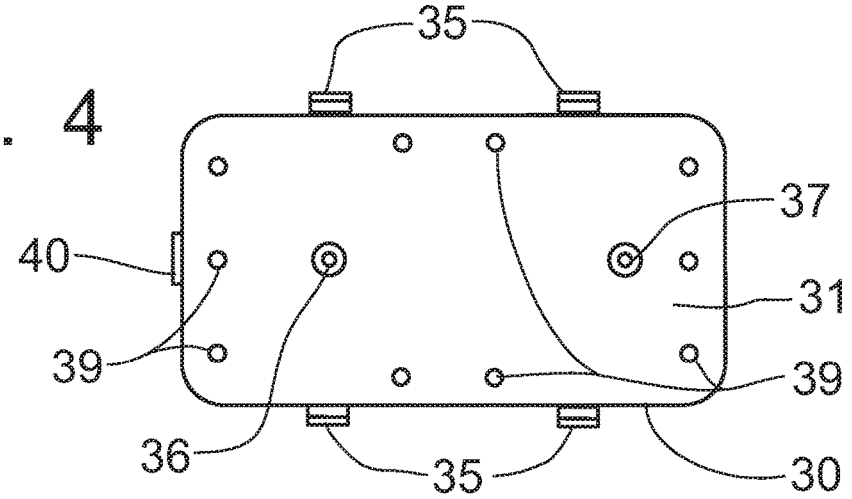
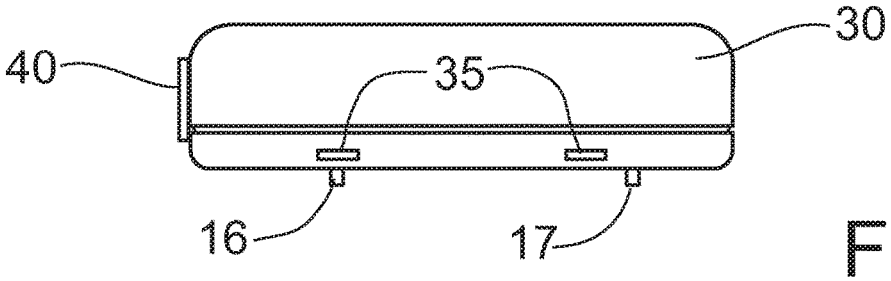
Fig. 5

Fig. 6
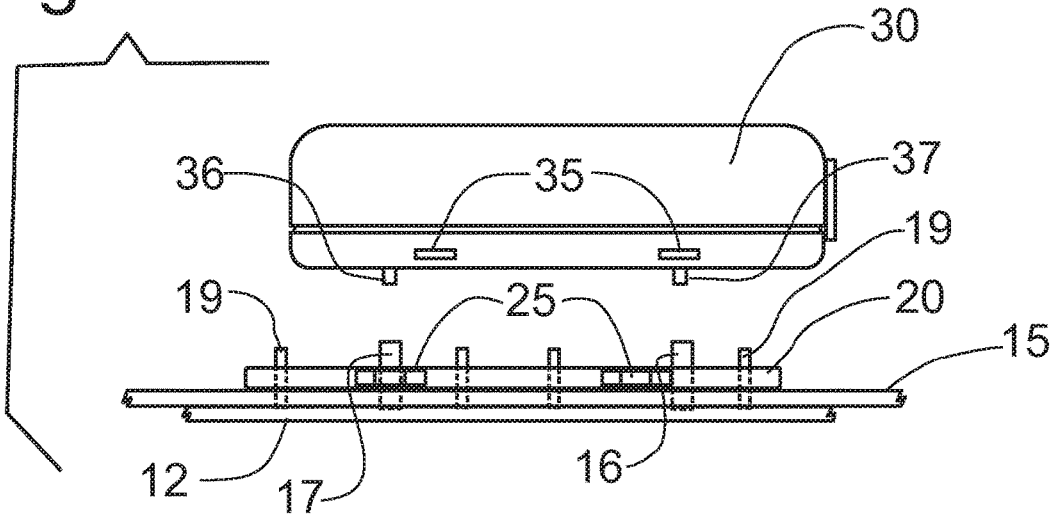
Fig. 7
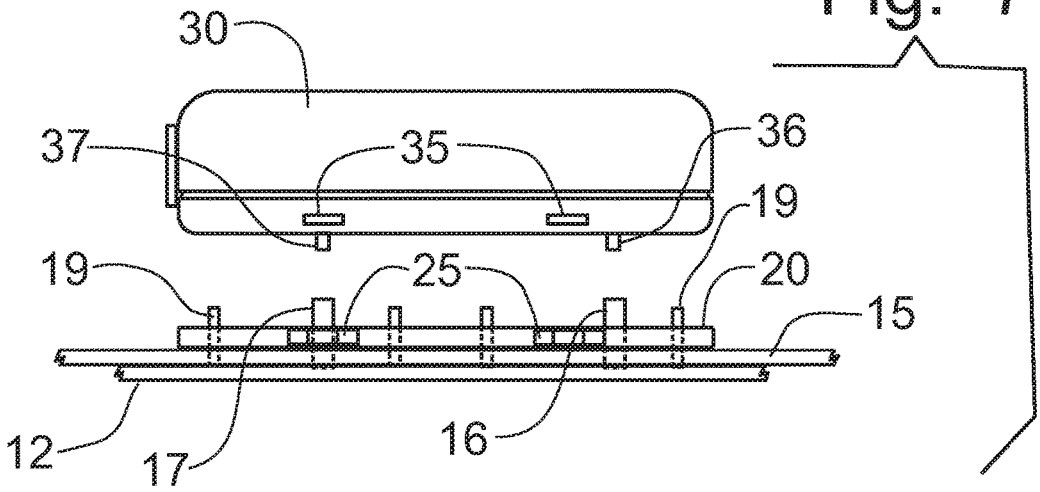
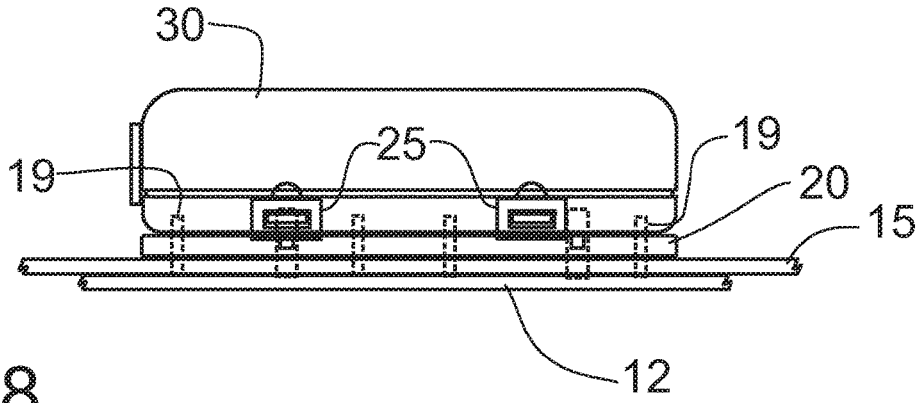
Fig. 8

Fig. 11
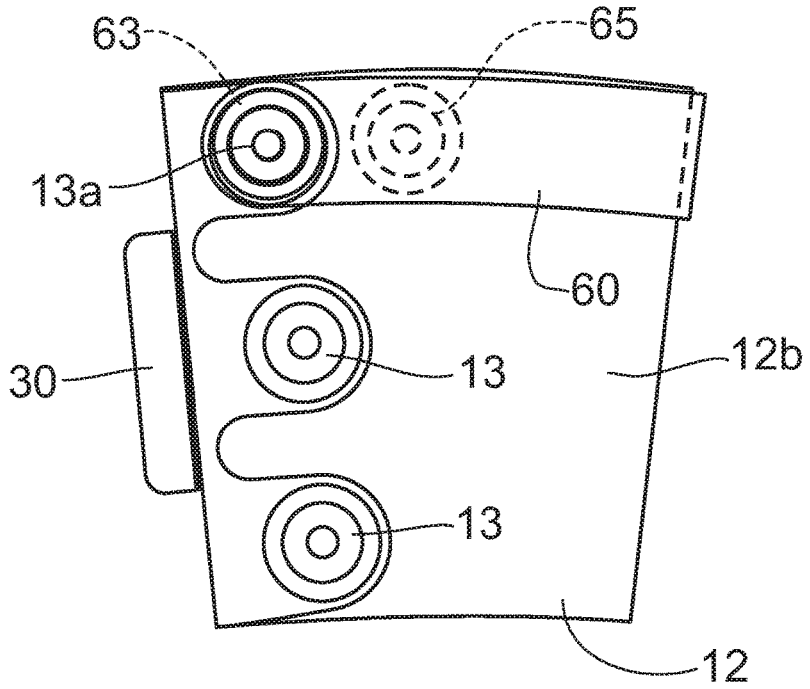
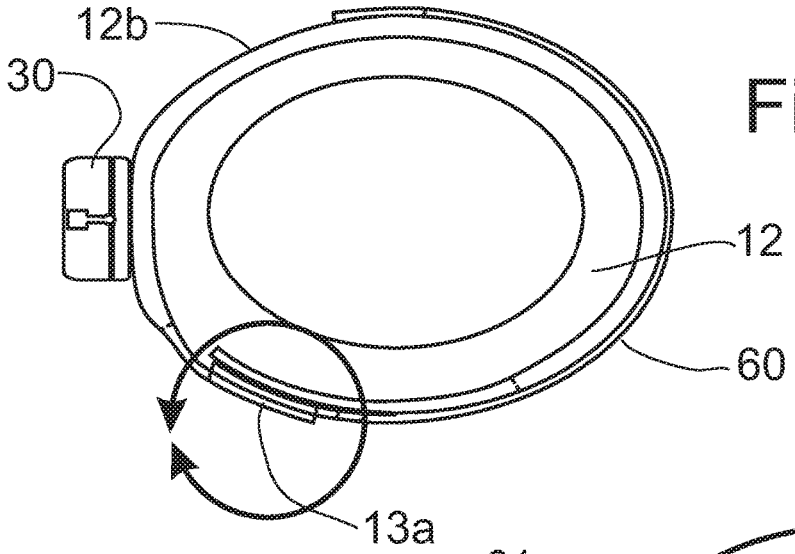
Fig. 12
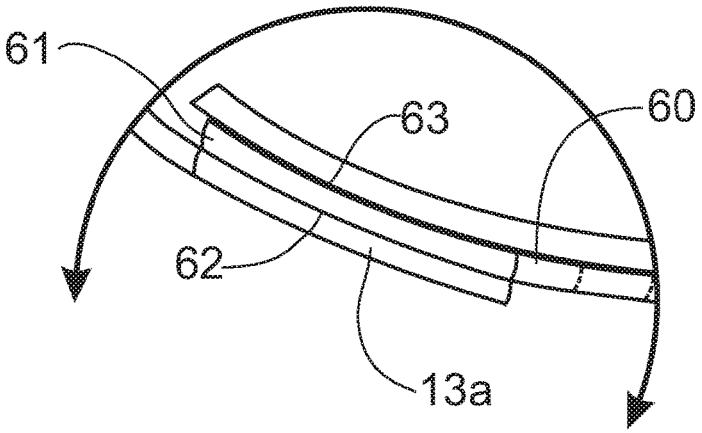
Fig. 13

Fig. 14
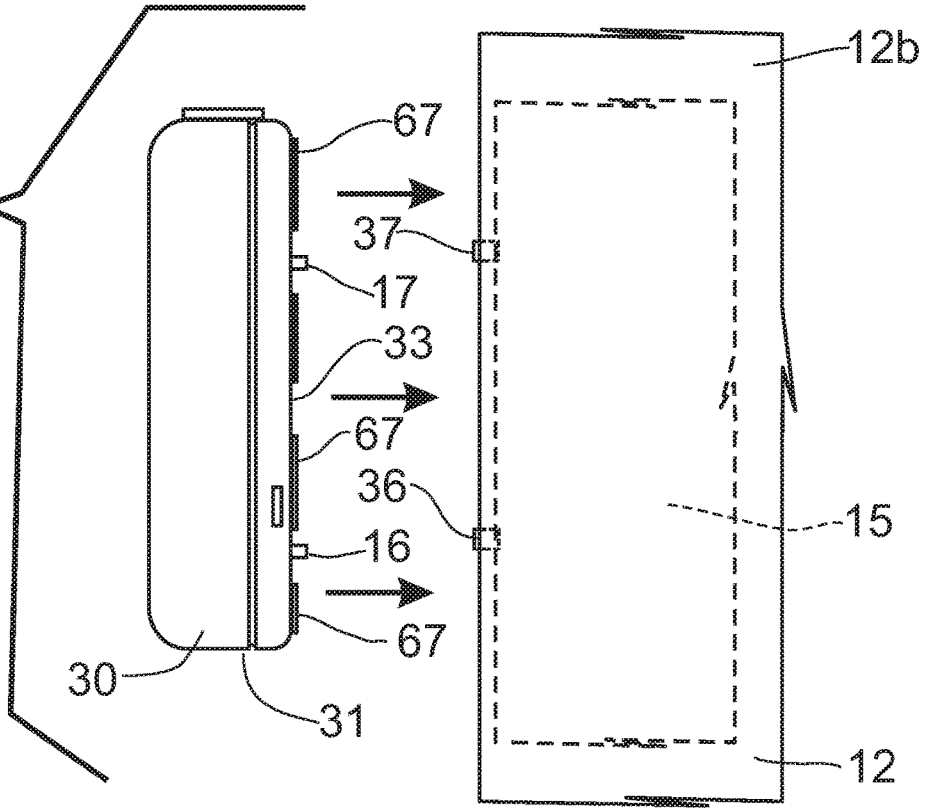
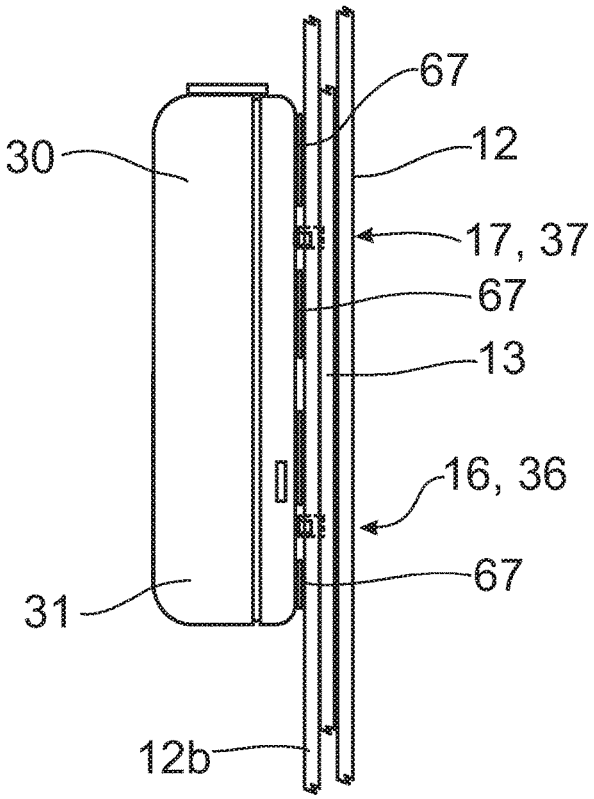
Fig. 15

INFLATION GARMENT HAVING A PORTABLE CONTROLLER FOR TREATMENT OF DVT

CROSS-REFERENCE TO RELATED APPLICATIONS

This application is a continuation-in-part of co-pending U.S. patent application Ser. No. 16/276,176, filed on Feb. 14, 2019 and granted as U.S. Pat. No. 10,500,125, on Dec. 10, 2019, which claims domestic priority on U.S. Provisional Patent Application Ser. No. 62/635,039, filed on Feb. 26, 2018, the content of which is incorporated herein by reference.

FIELD OF THE INVENTION

This invention deals generally with medical devices for the treatment of edema and deep venous thrombosis, and more specifically to an inflatable garment with a portable controller mounted directly on the inflatable garment.

BACKGROUND OF THE INVENTION

Medical patients undergoing surgery, particularly with anesthesia, and patients having extended periods of immobility have a propensity to form clots in the deep veins of the lower extremities, typically referred to as deep venous thrombosis (DVT) and peripheral edema. These veins return, deoxygenated blood to the heart and when blood circulation in these veins is restricted from activity there is a tendency for the patient's blood to accumulate, which can lead to the formation of a blood clot resulting in a potentially dangerous interference with cardiovascular circulation. Most seriously, however, a fragment of the blood clot can break loose and migrate to the patient's lungs to form a pulmonary embolism, which if blocking a main pulmonary artery, may be life threatening.

These conditions and the resulting risks associated with patient immobility may be controlled or alleviated by applying intermittent pressure to a patient's limb to assist in the circulation of the blood to prevent pooling or accumulation of blood due to inactivity. Various conventional compression devices are known for applying compressive pressure to a patient's limb. These types of devices are used to assist in a large number of medical indications, including the prevention of DVT, vascular disorders, reduction of edemas and lymphedema. These devices can be used in the hospital or in home therapy. These devices can provide sequential compression to the limb or compression of the limb from a single air bladder.

The use of inflatable garment therapy has proven successful in the treatment of lymphedema and DVT, but such devices require electrical power to operate. Older versions of these devices were connected to 120V electrical current, which means that utilization of the devices required a stationary presence for the patient near a wall outlet in order to plug in the power supply. More recent versions of the devices have been adapted to being powered through batteries, typically rechargeable batteries that are incorporated into a housing with the DC powered compressor and other controls, including an electronic controller that can be programmed to provide a number of different variations of the therapy. These small battery powered controllers provide a freedom of movement without treatment interruption; a convenient apparatus that can be used at home by the patient; ease of handling and storage; and a convenient apparatus that can be operated while the patient is doing other things.

In U.S. Pat. No. 8,394,042 granted on Mar. 12, 2013, to Mansoor Mirza; in U.S. Pat. No. 8,403,870, granted on Mar. 26, 2013, to Mark A. Vess; in U.S. Pat. No. 8,784,346, granted on Jul. 22, 2014, to Jakob Barak; in U.S. Pat. No. 9,044,372 granted on Jun. 2, 2015, to David G. Wild, et al; and in U.S. Pat. No. 9,668,932 granted on Jun. 6, 2017, to Orlando Mansur, Jr., et al, inflatable garment devices for providing DVT or lymphedema therapy through manipulation of the inflation of multiple air bladders. In each patent, the controller is portable, although most of these prior art patents do not teach the mounting of the controller directly onto the inflatable garment itself, and the controller is battery powered, typically through rechargeable batteries.

U.S. Pat. No. 8,177,734, granted on May 15, 2012, to Mark A. Vess; and U.S. Pat. No. 8,801,643, granted on Aug. 12, 2014, to Manish Deshpande, et al, disclose a portable inflation therapy garment in which the controller is directly mounted to a port that is adapted to receive male connector components on the controller within female connector components formed in the fixed port with connection therebetween being accomplished through a snap-fit arrangement. Thus, the controller is carried by the sleeve of the inflation therapy garment and is detachable therefrom. These configurations of a port or mount on the sleeve as taught in the Vess and Deshpande patents are complex devices that are not removable from the garment, even though the controller is removable.

It would be desirable to provide all inflatable garment apparatus for DVT and lymphedema therapy in which the controller can be mounted onto the sleeve of the inflatable garment in a manner to be detachable therefrom and to permit the sleeve to be replaceable at minimal cost while enabling the controller to be used with other sleeve devices.

SUMMARY OF THE INVENTION

It is an object of this invention to provide an inflatable garment apparatus for DVT and lymphedema therapy that overcomes the disadvantages of the prior art.

It is another object of this invention to provide an inflatable garment apparatus for DVT and lymphedema therapy that operates through a battery powered pump and controller mounted on the inflatable garment.

It is a feature of this invention that the battery powered pump and controller are detachable from the inflatable garment.

It is an advantage of this invention that the batteries for the removable pump and controller can be recharged while separated from the inflatable garment.

It is another feature of this invention that the battery powered pump and controller is contained within a housing that is detachable mounted onto the inflatable garment.

It is still another feature of this invention that the inflatable garment is formed with a plastic interface plate for supporting the housing of the portable air pump and controller.

It is yet another feature of this invention that the interface plate is formed with a plurality of mounting spikes that engage openings in the housing for the portable air pump and controller to affect attachment of the housing to the interface plate.

It is another advantage of this invention that the housing for the portable air pump and controller includes air inlet and discharge receivers that automatically engage air inlet and air discharge ports for the bladder of the inflatable garment.

It is still another advantage of this invention that the air inlet receiver and the air discharge receiver are asymmetrically positioned on the air pump and controller housing so that the air pump and controller cannot be mounted improperly on the inflatable garment.

It is another feature of this invention that the interface plate includes latch members that are selectively positionable to engage retainer knobs formed on the housing for the air pump and controller to secure the portable air pump and controller on the interface housing.

It is yet another advantage of this invention that the air pump and controller housing can only be mounted onto the interface plate if the housing is properly oriented for engagement of the air inlet and air discharge receivers with the proper ports on the inflation garment bladder.

It is yet another feature of this invention that the bladder for the inflation garment has a single chamber for providing inflation therapy.

It is still another object of this invention to provide a multiple chamber inflation garment that inflates sequentially through operation of the detachable battery powered air pump and controller.

It is another feature of this invention that the respective chambers have valves disposed between the respective chambers to affect sequential pressurizing of the chambers.

It is another advantage of this invention that the valves allow the discharge of air in the chambers simultaneously to complete a therapy cycle.

It is still another feature of this invention that portable air pump and controller can be detachably mounted on an interface plate incorporated into the inflatable garment.

It is yet another feature of this invention to provide a supplemental support that enhances the mounting of the inflation garment to a patient.

It is still another advantage of this invention that the inflation garment retains the mounted position on the patient's leg without slipping.

It is another feature of this invention that the supplemental support can be a separate member that can be detachably secured to the inflation garment or integrally incorporated into the inflation garment.

It is still another feature of this invention to provide an alternative mounting device for connecting the controller to the inflation garment.

It is yet another object of this invention to provide an inflation garment for providing treatment of DVT and having a portable, battery powered air pump and controller detachable connected thereto that is durable in construction, inexpensive of manufacture, easy to assemble, and simple and effective in use.

It is a further object of this invention to provide an inflation garment for DVT therapy that is formed with multiple sequentially pressurized chambers and operated by a battery powered, detachable air pump and controller mounted on the inflation garment that is durable in construction, inexpensive of manufacture, easy to assemble, and simple and effective in use.

These and other objects, features and advantages are accomplished according to the instant invention by providing an inflation garment for the treatment of DVT is operated by a portable, battery powered air pump and controller detachably mounted on the inflation garment. The controller is formed with hook-fastening devices on the bottom surface of the controller that is detachably engagable with the material on the outer surface of the inflation garment. To mount the controller, the inflation garment is folded to expose the air inlet and outlet ports on the inflation garment to facilitate the operative attachment of the controller ports, then the inflation garment is unfolded and pressed against the bottom surface of the controller to engage the hook fasteners with the material of the inflation garment. A supplemental support is provided to wrap at least partially around the inflation garment to enhance the support of the inflation garment on the patient's limb without slipping.

BRIEF DESCRIPTION OF THE DRAWINGS

The foregoing and other objects, features, and advantages of the invention will appear more fully hereinafter from a consideration of the detailed description that follows, in conjunction with the accompanying sheets of drawings. It is to be expressly understood, however, that the drawings are for illustrative purposes and are not to be construed as defining the limits of the invention.

FIG. 3 is an enlarged detail schematic plan view of the top surface of the controller and the mounting panel used to mount the controller to the outer surface of the inflation therapy garment;

FIG. 4 is a schematic plan view of the underside of the controller that is engagable with the mounting panel shown in FIG. 3:

FIG. 5 is a schematic side elevational view of the controller shown in FIG. 4;

FIG. 6 shows an improper mounting of the controller onto the mounting panel to illustrate that the configuration of the mounting panel and engagable underside of the controller prevents an improper mounting thereof;

FIG. 7 is similar to FIG. 6, but shows the proper orientation of the controller with respect to the mounting panel;

FIG. 8 is a completed mounting of the controller onto the mounting panel in an operable configuration;

FIG. 11 is a schematic side elevational view of an inflation garment shown in FIG. 10 in a configuration wrapped around a patient's limb with the supplemental support wrapped around the inflation garment;

FIG. 12 is a schematic top plan view of the configuration of the inflation garment shown in FIG. 11;

FIG. 13 is an enlarged schematic detail view of the connection between the inflation garment and the supplemental support corresponding to circle 13 in FIG. 12;

FIG. 14 is a schematic exploded elevational view of the mounting of the controller formed with hook fasteners on the bottom surface to the inflation garment, the inflation garment being schematically shown as being folded about the line between the air inlet and outlet ports; and FIG. 15 is a schematic elevational view of the controller formed with hook fasteners on the bottom surface mounted on the corresponding portion of the inflation garment.

DETAILED DESCRIPTION OF THE PREFERRED EMBODIMENT

Figure 1:
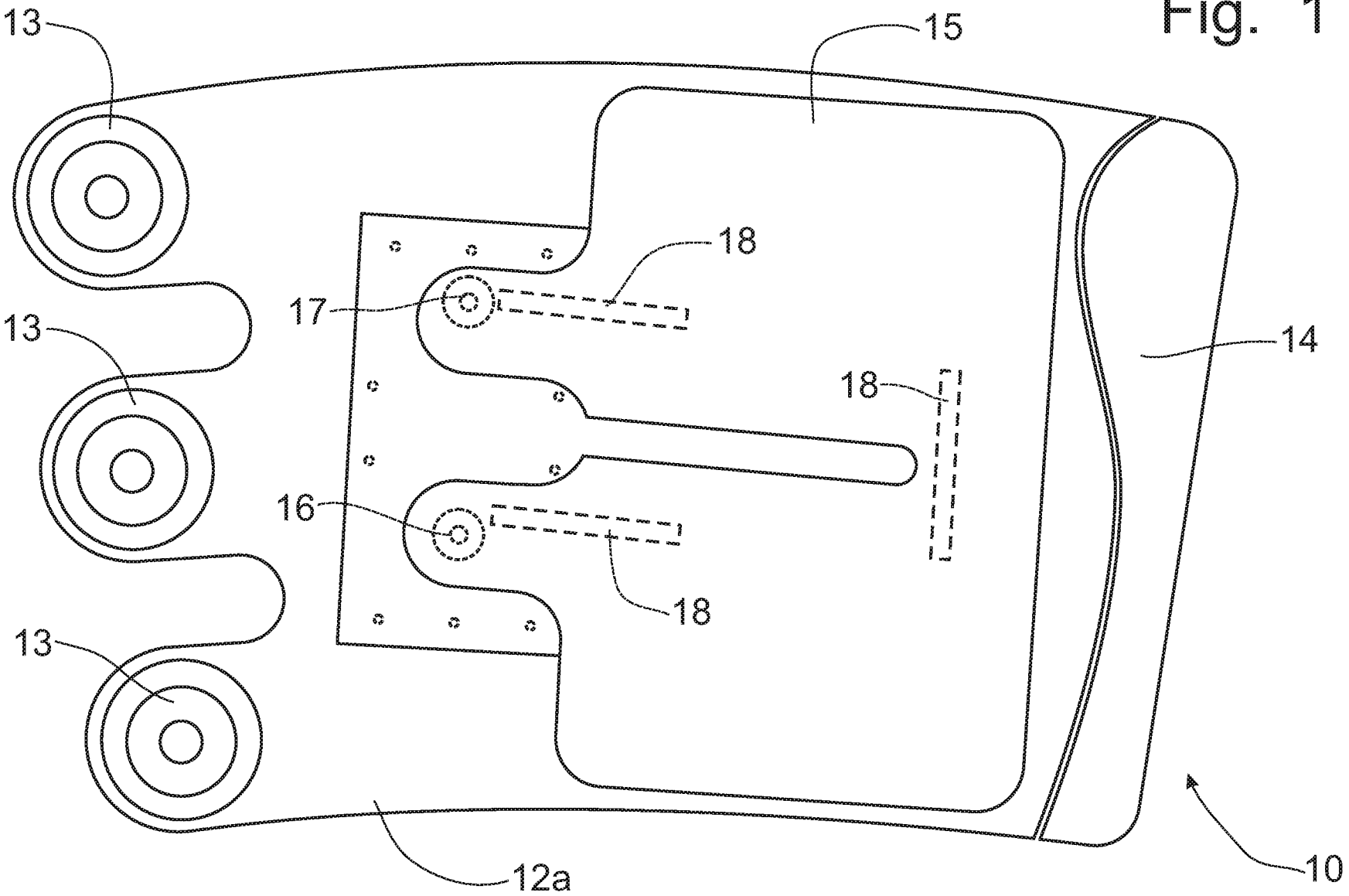
FIG. 1 is a schematic partial plan view of an inside surface of an inflation therapy garment incorporating the principles of the instant invention, the tail portion of the garment is broken away for purposes of clarity.
Figure 2:
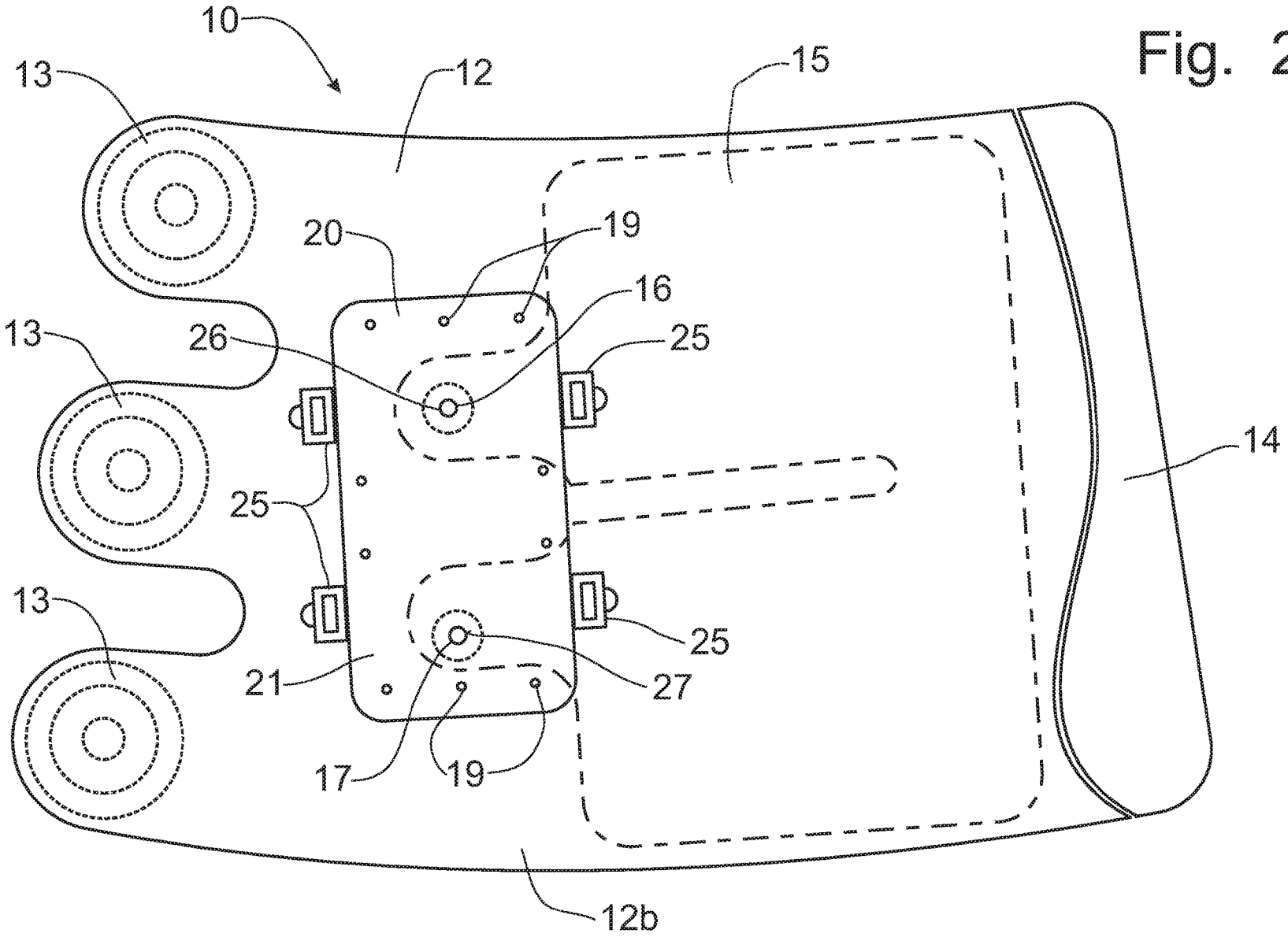
FIG. 2 is a schematic partial plan view of the outer surface of the inflation therapy garment shown in FIG. 1.

Referring to the drawings, an inflation therapy garment incorporating the principles of the instant invention can best be seen. The inflation therapy garment 10, as best seen in FIGS. 1 and 2, includes a wraparound member 12 preferably of a length that will be capable of wrapping around the limb of a patient requiring the inflation therapy into which is secured an air bladder 15 that will inflate to apply pressure to the patient's limb, as will be described in greater detail below. Preferably, the wraparound member 12 is constructed of a soft flexible material such as cloth to provide a comfortable fit for the patient. One side of the wraparound member 12 is shaped with multiple fasteners 13, preferably hook and loop fasteners that will engage with the cloth material on the tail end 14 of the wraparound member 12, after being placed onto the patient's limb.

The wraparound member 12 has an inside surface 12*a*, shown in FIG. 1, and an outside surface 12*b*, shown in FIG. 2. The air bladder 15 is mounted on the inside surface 12*a* and preferably covered with a cloth covering (not shown) to provide a barrier between the plastic bladder 15 and the skin on the patient's limb. The air bladder 15, best seen in FIG. 1, extends substantially across the width of the wraparound member 12, but preferably has a length dimension that is substantially less than the corresponding length dimension of the wraparound member 12. The bladder 15 is formed with an air inlet port 16 and an air discharge port 17. Air pumped into the air inlet port 16 will inflate the bladder 15, stretching the wraparound member 12 against the patient's limb and pushing fluid within the patient's limb away from the extremity of the patient's limb. By inflating the bladder 15 and then releasing the pressure through the air discharge port 17, as described in greater detail below, the patient will benefit from the inflation therapy.

Preferably, the bladder 15 is shaped in a U-shaped configuration that provides a flow path for the air from the air inlet port 16 to the air discharge port 17. The bladder 15 may incorporate spacer strips 18 that are positioned proximate to the air inlet and discharge ports 16, 17, and at the bight of the U-shaped configuration of the bladder 15 to keep the bladder 15 from collapsing during the passage of air through the bladder 15. One skilled in the art will recognize that the bladder 15 can take many different shapes and configurations, including multiple bladders arranged for sequential filing and discharge to provide a progressive inflation of the bladders to facilitate the movement of fluid within the patient's limb.

Built into the fringes of the bladder 15 at the air inlet port 16 and the air discharge port 17 are a series of plastic mounting spikes 19 that project out of the wraparound member 12 on the outside surface 12*b* thereof. Preferably, the plastic mounting spikes 19 are an integral part of the wraparound member 12 and not removable therefrom, as is the bladder 15. An interface plate 20 is detachably mounted on the plastic mounting spikes 19 which fit through corresponding holes 22 in the interface plate 20. Preferably, the plastic mounting spikes 19 fit through the holes 22 with an tight, almost interference fit which permits the interface plate 20 to be removed from the wraparound member 12, but not easily so. The plastic mounting spikes 19 are preferably formed with slightly enlarge heads that deform slightly with pressure to allow the interface plate 20 to be mounted on the plastic mounting spikes 19 and to be removed therefrom. Furthermore, the air inlet port 16 and the air discharge port 17 pass through corresponding openings 26, 27 in the interface plate 20 in a manner such that the air inlet port 16 and the air discharge port 17 from the air bladder 15 project above the interface plate 20 to permit engagement with the air pump and controller 30, as will be discussed in greater detail below.

The interface plate 20 is also formed with latch members 25 along side portions thereof. Preferably, the latch members 25 are molded into the interface plate 20 and are formed with a live hinge at the junction of the latch members 25 and the planar body 21 of the interface plate 20. The latch members 25 are operable to fold upward into engagement with retainer knobs 35 on the sides of the housing 31 for the air pump and controller 30 when the air pump and controller 30 is mounted properly on the interface plate 20, as will be discussed in greater detail below. With the air pump and controller 30, along with the interface plate 20, being easily detached from the wraparound member 12, the wraparound member 12 becomes easily disposable as the controller 30 and interface plate 20 can be easily mounted on a replacement wraparound member 12 and, thus, reusing the air pump and controller 30. Therefore, as the wraparound member 12 becomes soiled or torn, the wraparound member 12 can be conveniently replaced at minimal cost, while reusing the controller 30 and interface plate 20.

The inflation therapy garment 10 is also provided with a detachable air pump and controller 30, which as noted above is detachably mounted on the interface plate 20. The air pump and controller 30 is best seen in FIGS. 3-5 and includes an outer housing 31 within which is operably mounted a small air compressor (not shown), valves (not shown) for controlling the air pressure within the air bladder 15, a power source (not shown) which is preferably a rechargeable battery, and a printed circuit board (not shown) which controls the operation of the air compressor and valves in a manner to provide inflation therapy to the patient's limb. The lower portion of the housing 31 is provided with the retainer knobs 35 to permit the housing 31 to be secured on the interface plate 20 by the latch members 25.

As best seen in FIGS. 3-5, the air inlet port 16 and the air discharge port 17 are not symmetrically oriented on the bottom of the housing 31, with preferably the sir discharge port 17 being closer to the corresponding end wall of the housing 31 than the air inlet port 16 is positioned relative to the opposing corresponding end wall. The purpose of this unsymmetrical arrangement is to require proper mounting of the controller 30 on the interface plate 20 when the controller 30 is being mounted on the wraparound member 12. The only orientation of the housing 31 that will engage all of the plastic mounting spikes 19 and the ports 16, 17, is with the air inlet port 16 being in connection through the inlet receiver 36 that is operatively connected to the air pump and the air discharge port 17 being in connection through the discharge receiver 37.

The mounting of the controller 30 onto the wraparound member 12 is depicted in FIGS. 6-8. In FIG. 6, the controller housing 31 is improperly aligned. Although the air inlet port 16 and the air discharge port 17 could be aligned for engagement with the corresponding inlet and discharge receivers 36, 37, the plastic mounting spikes 19 will not engage into the sockets 39 that are spaced around the periphery of the bottom portion of the controller housing 31.

In FIG. 7, the controller housing 31 is turned 180 degrees with respect to the misaligned position depicted in FIG. 6, so that all of the plastic mounting spikes 19 will be aligned with the corresponding sockets 39, and the air inlet and discharge ports 16, 17 are aligned with the corresponding inlet and discharge receivers 36, 37. As is reflected in FIG. 8, the controller housing 31 is pressed onto the interface plate 20 with the housing engaging the plastic mounting spikes 19 and air inlet and discharge ports 16, 17 projecting upwardly through the interface plate 20. Once properly seated with all components engaged correctly, the latch members 25 can be flipped upwardly and engaged with the corresponding retainer knobs 35 to secure the controller housing 31 to the interface plate 20, which is in turn mounted by an interference fit between the plastic mounting spikes 19 and the corresponding openings through the interface plate 20.

Once the prescribed inflation therapy is completed, the controller 30 can be removed from the interface plate 20 by unlatching the latching members 25 from the retainer knobs 35 and then lifting the housing 31 off of the plastic mounting spikes 19 and the air inlet and discharge ports 16, 17, which also preferably have a tight fitting relationship with the corresponding openings in the housing 31. The controller 30 can then be connected to a charging device (not shown) through the charging port 40 at the end of the controller housing 31.

Referring now to the schematic view of FIG. 1, the inside surface of an inflation therapy garment having multiple inflation chambers and being operated by the battery powered, portable air pump and controller detachably mounted on an interface plate is best seen. The multiple chambered inflation therapy garment 40 includes a wraparound member 42, an interface plate 20 and an associated air bladder 45 secured to the wraparound member 42, similar to that described above with respect to FIGS. 1 and 2. However, the air bladder 45 is a multiple chambered bladder 45, as opposed to the single inflation chamber in the first embodiment shown in FIGS. 1 and 2. In the preferred embodiment shown in FIG. 9, the air bladder 45 is formed with three chambers 46, 47 and 48. The air inlet port 16 is located in the first chamber 46 and the air discharge port 17 is located in the third chamber.

Figure 9:
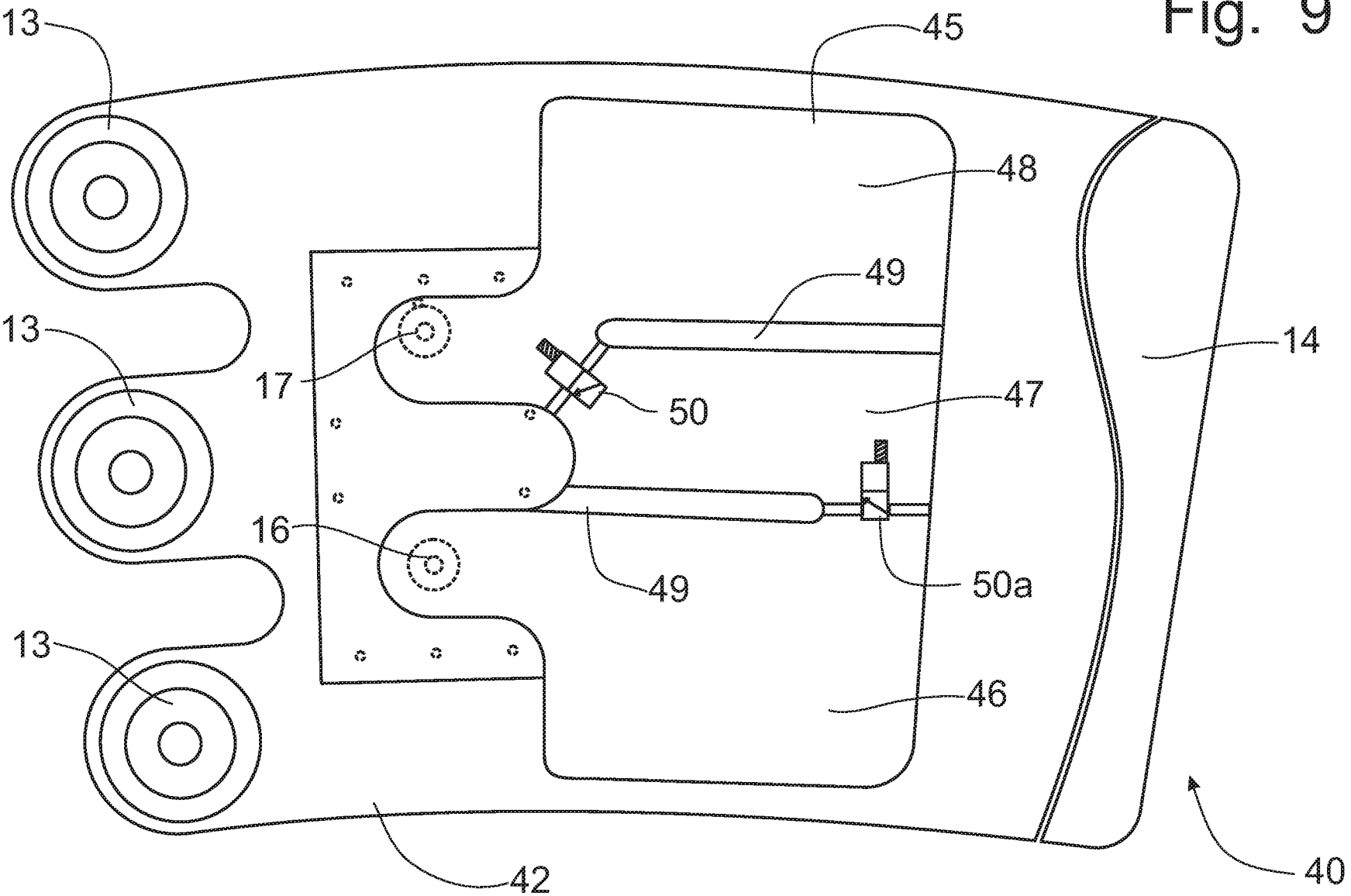
FIG. 9 is a schematic partial plan view of an inside surface of an inflation therapy garment having three sequentially inflated chambers and incorporating the principles of the instant invention, the tail portion of the garment is broken away for purposes of clarity.
Figure 10:
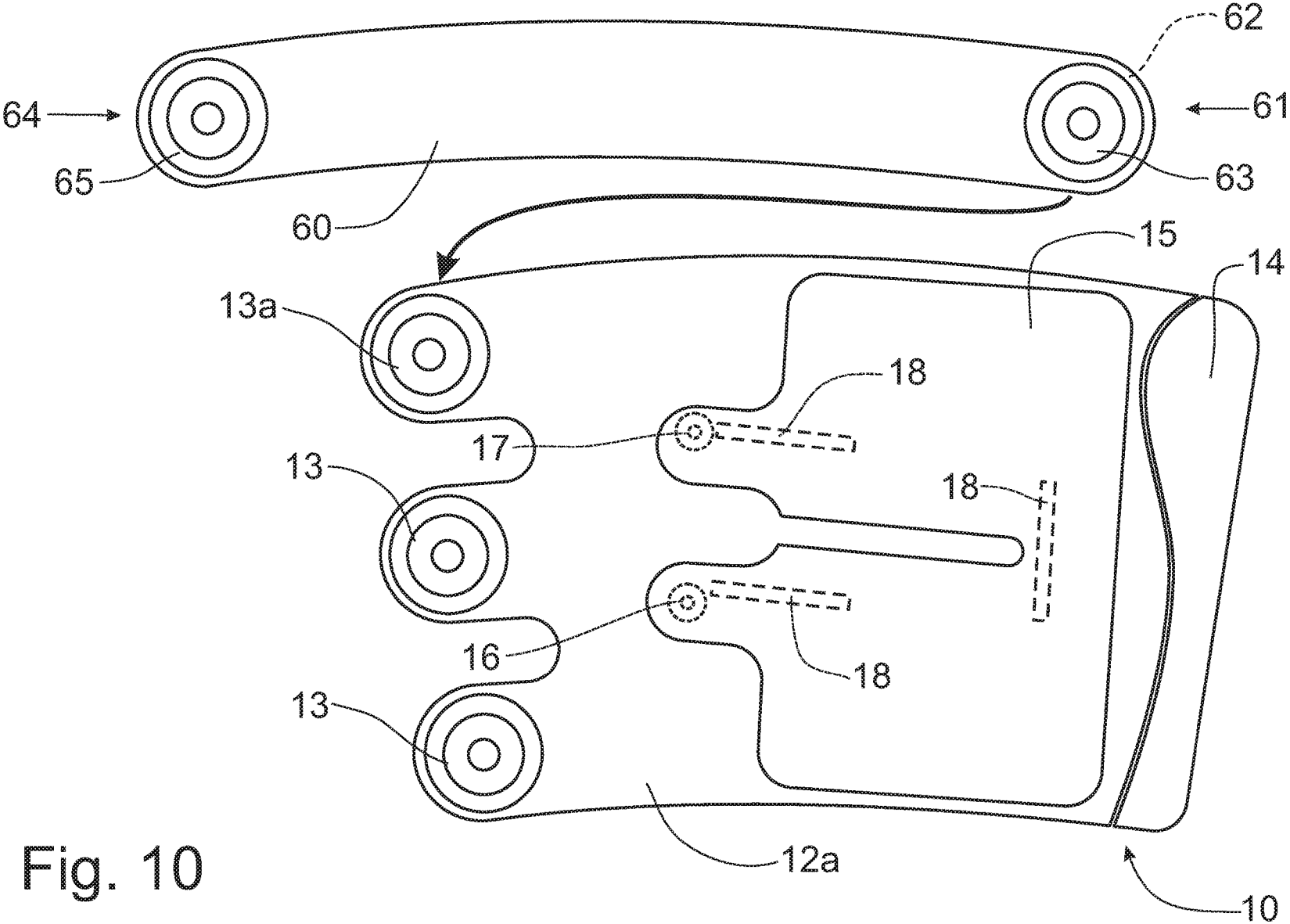
FIG. 10 is a schematic partial plan view of an inside surface of an inflation therapy garment with the addition of the supplemental support to enhance the mounting of the inflation garment on the patient's limb, the tail portion of the garment being broken away for purposes of clarity.

Between the respective chambers 46-48, which are separated by barriers 49, the passageway around the respective barriers 49 from one chamber to another is blocked by a valve apparatus 50 symbolically shown in FIG. 9. The valve assemblies 50 are operable to restrict the flow of air from one chamber to another until the pressure in the lower chamber reaches a predetermined value. Then, the valve assemblies 50 will allow the passage of air through the valve assembly 50 into the succeeding chamber. Once the third chamber 48 is pressurized, the air discharge port 17 is opened through the operation of the controller 30 mounted on the interface plate 20. The valve assemblies 50 will permit the air to escape from the respective chambers 46-48 until the bladder 45 is deflated, whereupon the sequential pressurizing operation re-cycles.

Referring now to FIGS. 10-13, an alternative embodiment of the instant invention can best be seen. The inflation therapy garment 10 has been known to slip when mounted on a patient's leg, allowing the inflation therapy garment 10 to move downwardly along the patient's leg to a less effective position on the patient. To enhance the mounting of the wrap around member 12 on the patient's limb, a supplemental support member 60 is provided to connect to the uppermost fastener 13*a* and wrap around the outer surface 12*b* of the wrap around member 12 to assert additional force around the patient's limb to secure the positioning thereof.

The supplemental support member 60 has a first end 61 bearing a connector member 62 that has a loop fastener on one side, which can be provided by the material on the outer surface of the supplemental support member 60 that is preferably the same material forming the outer surface of the wrap around member 12, or the loop fastener could be a separate disk attached to the first end 61. The first end 61 also includes on the opposite side from the loop fastener 62 a hook fastener 63, which is preferably a disk connector attached to the first end 61 of the supplemental support member 61. The opposing second end 64 of the supplemental support member 60 also has a hook fastener/connector 65 on the same side of the supplemental support member 61 as the hook fastener 63.

Thus to use the supplemental support member 60, the patient would attach the loop fastener 62 on the first end 61 to the uppermost fastener 13 on the inflation garment 10. The patient would then stretch the wrap around member 12 around the patient's limb starting preferably with the lowermost fastener 13 and attaching the fastener 13 to the outer surface 12*b* of the wrap around member 12. The stretching process is repeated with the connection of the middle fastener 13. The stretching process is again repeated for the uppermost fastener 13*a*, but the hook fastener 63 opposite from the loop fastener 62 on the first end 61 of the supplemental support member 60 is engaged with the outer surface 12*b* of the wrap around member 12. The supplemental support member 60 is then stretched around the patient's limb following which is the hook fastener 65 at the second end 64 is attached to the outer surface 12*b* of the wrap around member 12.

One of ordinary skill in the art will recognize that the supplemental support member 60 can be integrally formed as part of the wrap around member 12, instead of being a separate detachable member 60. In such cases, the location for the uppermost fastener 13*a* should continue to be engagable with the outer surface of the wrap around member 12 and then the extended length of the supplemental support would wrap around the patient's limb and have a hook fastener engage with the outer surface 12*b* in much the same way as the separate supplemental support member 60 described above.

Referring now to FIGS. 14 and 15, an alternative embodiment for attaching the controller 30 to the wrap around member 12 can best be seen. The controller 30 can be attached to the wrap around member 12 by hook fastener devices 67 which can be spaced around the periphery of the bottom surface 33 of the housing 31, as reflected in FIGS. 14 and 15, or covering all or most of the bottom surface 33 of the housing 31. Before the inflation garment 10 is applied to the patient's limb, the controller 30 bearing the hook fastener devices 67 can be attached by first folding the wrap around member 12 over itself along the line extending between the air inlet and outlet ports 16, 17, and then inserting the air receiver and discharge ports 36, 37 on the controller into the air inlet and outlet ports 16, 17 of the inflation garment 10. The folding of the wrap around member 12 enables the respective ports 16, 17, 36, 37 to be engaged without the hook fasteners 67 engaging the outer surface 12*b* of the wrap around member 12.

Once the ports of the controller 30 and the air bladder 15 are connected, the wrap around member can be unfolded to press the outer surface 12*b* of the wraparound member 12 for engagement of the hook fastener devices on the bottom surface 33 of the controller housing 31. Removal of the controller 30 for charging or servicing requires only that the hook fastener devices 67 be separated from the wrap around member 12 by grasping the controller 30 and the wrap around member 12 and pulling in opposite directions.

In operation, the deflated air bladder 45 receives a supply of air through the air inlet port 16 from the portable air pump and controller 30. The first valve assembly 50*a* positioned between the first bladder chamber 46 and the second bladder chamber 47 prevents the passage of air into the second chamber 47 until the first bladder chamber 46 is pressurized to a predetermined level. Then, the first valve assembly 50*a* opens to allow the air to move through the first valve assembly 50*a* into the second bladder chamber 47. Similar to the operation of the first valve assembly 50*a*, the second valve assembly 50*b* prevents the passage of air into the third bladder chamber 48 until the second chamber 47 has been pressurized to a predetermined level. Then, the air is allowed to pass through both valve assemblies 50 and the first and second chambers 46, 47 into the third bladder chamber 48. Once the third bladder chamber 48 is pressurized to a predetermined level, the air discharge port is opened for the release of the air from all three chambers 46-48. In this manner, the air bladder 45 is sequentially pressurized to provide an effective DVT therapy as an alternative to the operation of the first embodiment shown in FIGS. 1 and 2.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. An inflation therapy garment comprising:

a wraparound member having sufficient length to overlap when placed onto a patient's limb, said wraparound member including hook fastener connectors along one end thereof, said wraparound member further including an outer surface serving as loop fasteners operably engagable with said hook fastener connectors when corresponding ends of said wraparound member are overlapped;

an air bladder incorporated into said wraparound member and having a main body portion divided by a barrier into two interconnected chambers, each said chamber being formed with an extension having a width dimension and a length dimension that are smaller than corresponding width and length dimensions of the corresponding chamber, the extension of one said chamber having an air inlet port for inputting air under pressure into said one chamber of said air bladder and said extension of the other chamber having an air discharge port for releasing said air from said other chamber of said air bladder; and a controller for providing said air under pressure into said air bladder and for selectively releasing said air from said air bladder in a predetermined and selectable manner, said controller having a housing providing an air supply port for engagement with said air inlet port of said air bladder and an air return port for engagement with said air discharge port of said air bladder, said housing further including hook fastener devices mounted on a bottom surface of said housing for engagement with the loop fasteners of said outer surface of said wraparound member.

2. The inflation therapy garment of claim 1 wherein said hook fastener connectors include an uppermost hook fastener connector corresponding to an upper position when said opposing ends of said wraparound member are overlapped for placement on a patient's limb.

3. The inflation therapy garment of claim 2 further comprising an elongated supplemental support member that extends from said uppermost hook fastener connector and extends at least partially around said wraparound member.

4. The inflation therapy garment of claim 3 wherein said supplemental support member is a separate member from said wraparound member and includes a loop fastener at one end thereof for engagement with the uppermost hook fastener connector.

5. The inflation therapy garment of claim 4 wherein said supplemental support member further includes a first hook fastener connector at said one end on an opposing side of said supplemental support member from said loop fastener on said one end, and a second hook fastener connector at a second end of said supplemental support member on said opposing side distal from said first hook fastener connector, said loop fastener being engagable with said uppermost hook fastener connector while said first hook fastener connector engages said outer surface of said wraparound member beneath said uppermost hook fastener connector, said second hook fastener connector engaging said outer surface of said wraparound member at a location remote from said uppermost hook fastener connector.

6. An inflation therapy garment comprising:

a wraparound member having sufficient length to overlap when placed onto a patient's limb, said wraparound member including hook fastener connectors along one end thereof, said wraparound member further including an outer surface serving as loop fasteners operably engagable with said hook fastener connectors when corresponding ends of said wraparound member are overlapped;

an air bladder incorporated into said wraparound member and having a main body portion divided by a barrier into two interconnected chambers, each said chamber being formed with an extension having a width dimension and a length dimension that are smaller than corresponding width and length dimensions of the corresponding chamber, the extension of one said chamber having an air inlet port for inputting air under pressure into said one chamber of said air bladder and said extension of the other chamber having an air discharge port for releasing said air from said other chamber of said air bladder; and a controller detachably mounted on said wraparound member for providing a supply of air under pressure into said air bladder and for selectively releasing said air from said air bladder in a predetermined and selectable manner, said controller having a housing providing an air supply port for engagement with said air inlet port of said air bladder and an air return port for engagement with said air discharge port of said air bladder, said controller utilizing a battery for powering a movement of said supply of air through said air bladder, said controller being selectively detachable from said wraparound member to facilitate charging of said battery.

7. The inflation therapy garment of claim 6 wherein said controller housing has a bottom surface from which said air supply port and said air return port extend for engagement with said air inlet and air discharge ports of said air bladder, said bottom surface of said housing including at least one hook fastener device for engagement with said outer surface of said wraparound member for connection of said controller to said wraparound member.

8. The inflation therapy garment of claim 6 wherein said bottom surface of said housing includes a plurality of hook fastener devices spaced around a peripheral edge of said controller housing.

9. The inflation therapy garment of claim 6 wherein said hook fastener connectors include an uppermost hook fastener connector corresponding to an upper position when said opposing ends of said wraparound member are overlapped for placement on said patient's limb.

10. The inflation therapy garment of claim 9 further comprising an elongated supplemental support member that extends from said uppermost hook fastener connector and extends at least partially around said wraparound member.

11. The inflation therapy garment of claim 10 wherein said supplemental support member is a separate member from said wraparound member and includes a loop fastener at one end thereof for engagement with the uppermost hook fastener connector, a first hook fastener connector at said one end on an opposing side of said supplemental support member from said loop fastener on said one end, and a second hook fastener connector at a second end of said supplemental support member on said opposing side distal from said first hook fastener connector, said loop fastener being engagable with said uppermost hook fastener connector while said first hook fastener connector engages said outer surface of said wraparound member beneath said uppermost hook fastener connector, said second hook fastener connector engaging said outer surface of said wraparound member at a location remote from said uppermost hook fastener connector.

* * * * *